United States Patent [19]

Dyer et al.

[11] Patent Number: 4,995,378

[45] Date of Patent: Feb. 26, 1991

[54] THERAPEUTIC TABLE

[75] Inventors: Allan E. Dyer, 1400 Dixie Rd., Suite 703, Mississauga, Ontario, Canada; Ernest Savoia, Weston, Canada

[73] Assignee: Allan Dyer, Toronto, Canada

[21] Appl. No.: 376,154

[22] Filed: Jun. 30, 1989

Related U.S. Application Data

[63] Continuation of Ser. No. 135,533, Dec. 17, 1987, abandoned, which is a continuation of Ser. No. 860,985, May 8, 1988, abandoned.

[51] Int. Cl.[5] ..... A61H 1/02

[52] U.S. Cl. ..... 128/75; 128/72

[58] Field of Search ..... 128/70, 71, 75, 84, 128/33, 72; 272/130, 134, 137, 138, 139, 143, DIG. 5; 269/328

[56] References Cited

U.S. PATENT DOCUMENTS

| | | | |
|---|---|---|---|
| 1,205,649 | 11/1916 | Miller | 128/71 |
| 1,239,522 | 9/1917 | LaRock | 128/71 |
| 1,242,598 | 10/1917 | Riddle | 128/71 |
| 1,280,987 | 10/1918 | Gregory | 128/71 |
| 1,348,896 | 8/1920 | Riesland | 128/71 |
| 1,735,569 | 11/1929 | Gregory | 128/71 |
| 1,950,948 | 3/1934 | Murray | 128/75 |
| 1,982,843 | 12/1934 | Traver | 272/134 |
| 2,475,003 | 7/1949 | Black | 128/71 |
| 2,773,499 | 12/1956 | Nieden | 128/75 |
| 2,774,349 | 12/1956 | Judovich | 128/71 |
| 2,822,805 | 2/1958 | Hill | 128/71 |
| 2,856,917 | 10/1958 | Mack | 128/33 |
| 2,865,367 | 12/1958 | Sorenson | 128/71 |
| 2,910,061 | 10/1959 | Rabjohn | 128/70 |
| 3,086,518 | 4/1963 | Barlow | 128/75 |
| 3,238,936 | 3/1966 | Siedentop | 128/71 |
| 3,387,843 | 6/1968 | Chandler | 272/130 |
| 3,465,592 | 9/1969 | Perrine | 272/130 |
| 3,522,802 | 8/1970 | Morton | 128/71 |
| 3,848,467 | 11/1974 | Flavell | 272/DIG. 5 |
| 3,888,243 | 6/1975 | Powlan | 128/75 |
| 4,266,537 | 5/1981 | Bonin | 128/75 |
| 4,378,791 | 4/1983 | Sarrell | 128/71 |
| 4,638,793 | 1/1987 | Therkorn | 128/71 |
| 4,726,583 | 2/1988 | Olsen | 272/130 |

FOREIGN PATENT DOCUMENTS

| | | | |
|---|---|---|---|
| 790469 | 7/1968 | Canada | 272/130 |
| 3104832 | 1/1983 | Fed. Rep. of Germany | 128/75 |
| 1104639 | 6/1955 | France | 128/70 |
| 64819 | 7/1955 | France | 128/70 |
| 19500 | 5/1899 | Switzerland | 128/75 |

OTHER PUBLICATIONS

Tru-Trac; "Dial Description and Explanation of Timing Controls", p. 3; Tru-EZE Manufacturing Inc.; 10-72.

*Primary Examiner*—Edgar S. Burr
*Assistant Examiner*—Huong Q. Pham
*Attorney, Agent, or Firm*—Fetherstonhaugh & Co.

[57] ABSTRACT

This invention relates to a therapeutic table for providing traction in a prone position to a patient's lumbar region. The therapeutic table includes a frame; a table top having an upper-body section rigid with respect to the frame and a lower-body section slideable with respect to the frame, the said sections providing, in use, a separable surface for a patient to lie prone face down on the table top; hand grips rigid with respect to the upper-body section and accessible by a patient with arms above head to provide anchoring for upper body; a pelvic belt anchor rigid with respect to the lower-body section to provide, in use, an anchor to which the pelvic belt can be connected; and cylinder and piston drive for sliding the lower-body section in the frame to cyclically increase and decrease the distance between said hand grips and said pelvic belt anchors to cyclically apply traction to the lumbar region of the spine in use.

10 Claims, 3 Drawing Sheets

THERAPEUTIC TABLE

This application is a continuation, of application U.S. Ser. No. 135,533 abandoned, filed Dec. 17, 1987 which is a continuation of application U.S. Ser. No. 860,985 abandoned filed May 8, 1988.

This invention relates to a therapeutic table for providing traction to a patient's lumbar region.

Back pain is a common ailment and can represent a painful hindrance that prevents its sufferer from leading a fulfilling life both in leisure and in the workplace. The ailment is very prevalent and there is a need for a non-surgical and efficient form of treatment that would ease this suffering. One form of non-medical treatment is to apply traction to the lumbar region of the spine.

Previous to this invention the commonly used system of applying traction to the lumbar region of a patient was weights and pulleys. The patient was placed supine (face up) on his back and secured to a resting surface. Cords were extended from the patient, looped around suspended pulleys and were tied to raised weights which were released to provide a gravitational tugging. The weights thereby applied traction to the patient's back. This system had only limited success because it did not sufficiently isolate the region of the back, i.e. the lumbar region, to which the traction should have been applied. It was also cumbersome and difficult to quantify.

This invention provides a non-surgical therapeutic table that is efficient to use and alleviates back pain by applying traction in a prone position (face down), predetermined in respect of amount and time, to the lumbar region through the use of a separating table.

According to one aspect of the present invention, a therapeutic table for providing traction to a patient's lumbar region comprises a frame; a table top having an upper-body section rigid with respect to said frame and a lower-body section slideable with respect to said frame; the said sections providing, in use, a separable surface for a patient to lie prone face down on the table top; hand grips rigid with respect to the upper-body section and extending upwardly of the plane of the table top to be accessible by a patient with arms above head along a plane of the axis of the patient's spine to provide anchoring for the upper body; a pelvic belt anchor rigid with respect to the lower-body section to provide, in use, an anchor to which the pelvic belt can be connected; means for sliding the lower-body section in the frame to cyclically increase and decrease the distance between said hand grips and said pelvic belt anchors to cyclically apply traction through the patient's arms to the lumbar region of the spine in use.

The invention will be clearly understood with to the drawings in which.

Figure 1:
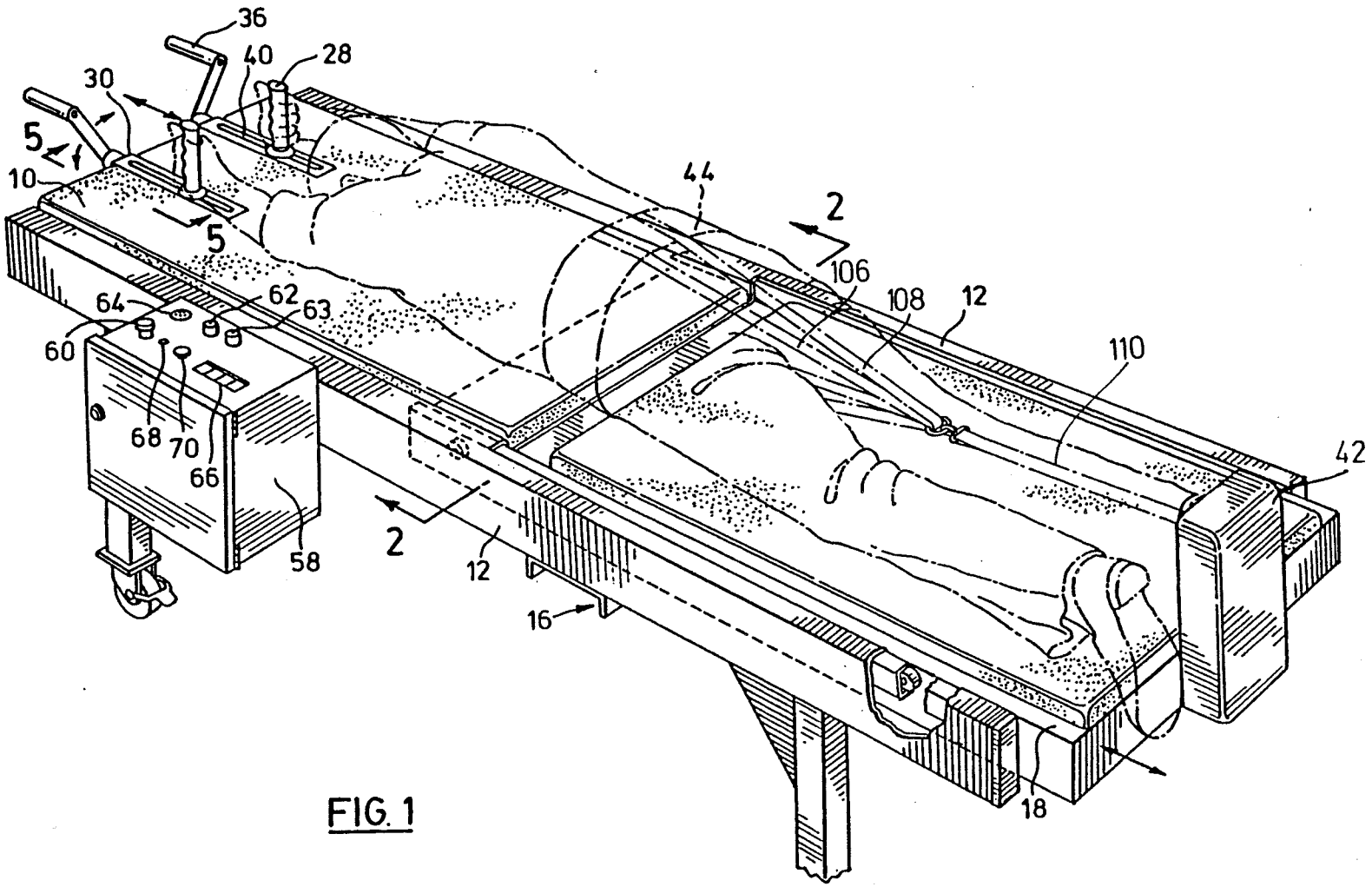
FIG. 1 shows an embodiment of a therapeutic table made according to this invention with a patient drawn in ghost lying prone face down on the table.

The therapeutic table illustrated in the drawings has a table top to support a patient face down as shown in FIG. 1.

The top of the table has an upper body section 10 that extends between channel-like side supports 12. The channel-like side supports 12 extend for the full length of the table but the upper body section 10 remains stationary to support the upper body of a patient in use. By "upper body", it is meant the area of the body above the waist level. The channel-like side supports 12 extend in bifocated fashion below the upper body section 10 and contain tracks 14 for the rollers 19 of the lower body section 18.

Crossmember 16 adds stability to the frame.

Lower body section 18 has laterally extending rollers 19 that engage in the tracks 14 and is slideable with respect to the upper body section 10. In use, the lower body section supports the lower body of the patient. By "lower body" it is meant the portion of the body at and below the waist level.

Figure 2:
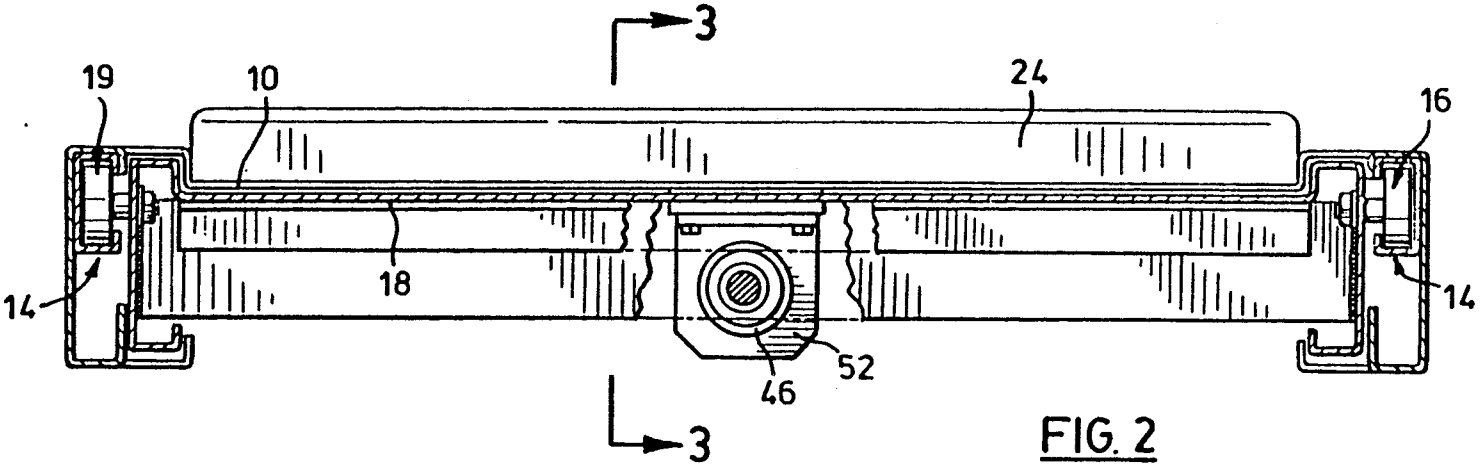
FIG. 2 is a cross section taken along 2—2 of FIG. 1.
Figure 3:
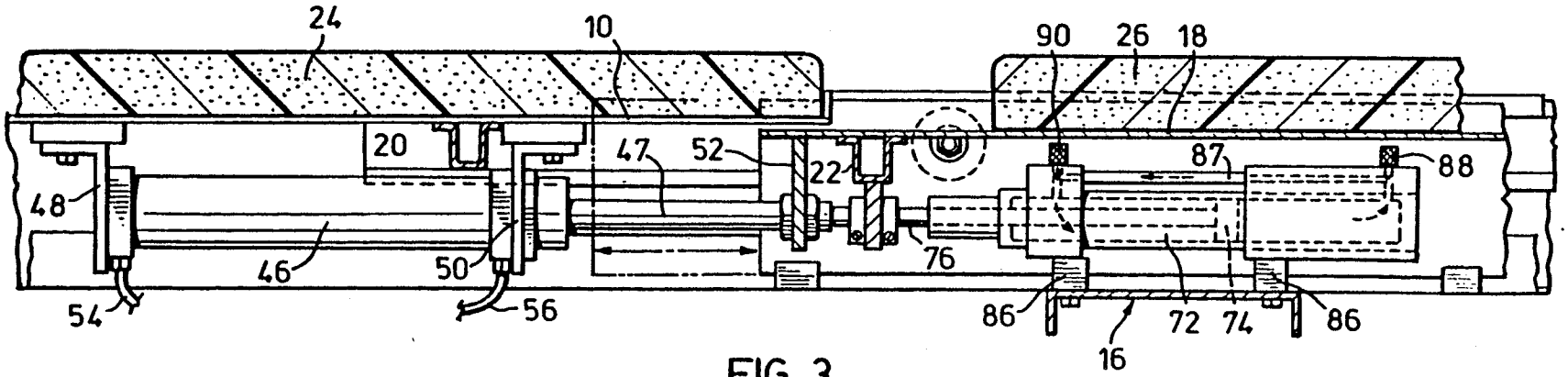
FIG. 3 is a cross section taken along 3—3 of FIG. 2.
Figure 4:
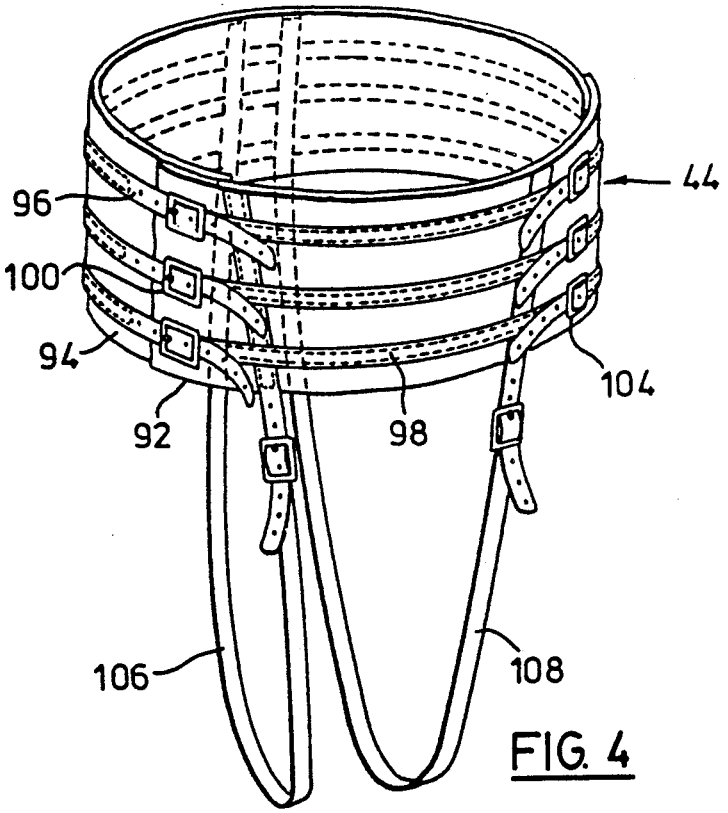
FIG. 4 shows a belt that may be used in combination with this invention.

The cross sections FIG. 2 and 3 illustrate the construction of the table sections. The sections are made from sheet metal bent as illustrated. Numerals 20 and 22 designate strengthening channels for the body support sections each of which have cushions 24 and 26. The upper body section 10 is integral with the frame.

It will be apparent from the description thus far that there is provided a table top with two body support sections 10 and 18, one being slideable with respect to the other.

Figure 5:
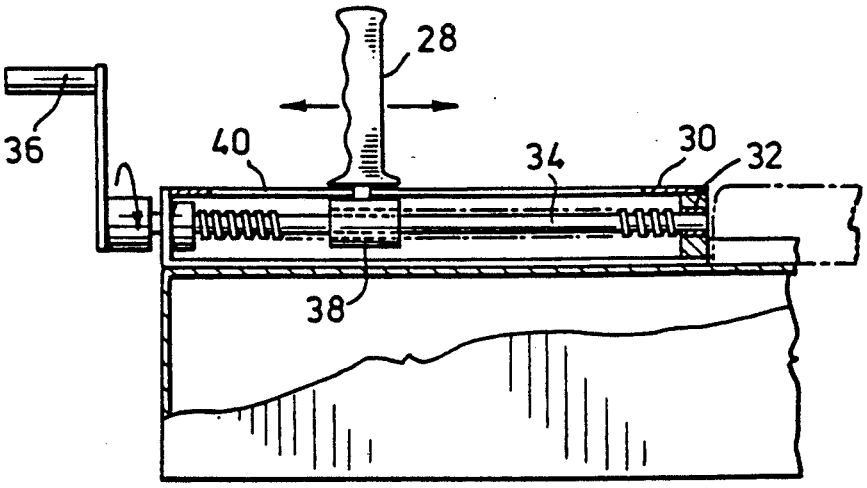
FIG. 5 is a cross-section taken along 5—5 of FIG. 1 showing the adjustable hand grips.

Hand grips 28 are provided. These grips extend from the frame and are adjustable longitudinally of the frame. Their construction is illustrated in FIG. 5. A housing 30 has bearings 32 for the screw 34. Crank 36 is provided to turn the screw in its bearings. A threaded block 38 of the screw extends through a slot 40 in the housing 30 and the handle grip 28 is mounted on the block. It will be apparent that by turning the crank 36, the blocks and their handle grips can be adjusted longitudinally of the table.

The lower body section 18 has a traction measuring meter 42 that also acts as an anchor for the pelvic belt 44. A clasp is mounted to the center of the traction measuring meter 42 to receive an end of a strap 110. In use, the strap is connected to the clasp. This permits an accurate gauging by the traction measuring meter 42 of the tension being applied to the patient. In alternative arrangements, it is possible to mount a bar, that extends horizontally along an axis perpendicular to the longitudinal axis of the table, to the traction measuring meter 42. Straps connected laterally to each side of the pelvic belt 44 could then be attached to opposing ends of the bar to permit bilateral traction of the pelvic belt.

Means are provided for sliding the lower body section 18 with respect to the upper-body section 10 to increase and decrease the distance between the hand grips and the pelvic anchor whereby one can controllably apply traction to the spine. In the embodiment shown the means comprises a double acting air cylinder 46. The air cylinder 46 is rigidly mounted with respect to the frame and upper body section 10 by brackets 48 and 50; and the free end of its piston rod 47 connects with a bracket 52 that depends from the bottom of the lower body section 18.

It will be apparent that as the piston rod 47 moves outwardly, the lower body section moves away from the upper body section and that as the piston rod 47 moves inwardly the lower body section moves towards the upper body section.

The pneumatic cylinder 46 has two inlets 54 and 56. Air to inlet 54 moves the piston rod 47 to the right and air to inlet 56 moves the piston rod 47 to the left in FIG. 3.

Air supply to the inputs 54, 56 is regulated by the operator through the use of a control box 58. The control box includes a pressure regulator switch 60 for setting the pressure of the air fed to the cylinder 46. A timer 62 controls the application of pressure to the two inlets of the cylinder 47. It applies pressure to inlet 54 for a predetermined time, then cuts supply to inlet 54 and applies it to inlet 56. It does this cyclically for the duration of treatment. A pause timer 63 regulates the amount of pause for which the lower body section 18 remains against the upper body section between cycles. When the lower body section 18 is drawn back against the upper body section 10, the pause timer is activated to hold the table sections in closed relationship for a set period. After the period set by the pause timer 72 has elapsed, the air is cut off from being fed into inlet 56 and is applied into inlet 54. This starts the cycle over again. A pressure gauge 64 gives a reading of the input pressure. A traction tension gauge 66 gives a reading of the traction applied to the pelvic belt 44 as determined by the traction measuring meter 42. A start button 68 is pushed to commence the treatment, and a stop button 70 may be pressed to terminate the treatment. Alternatively, a timer (not shown) may be used to terminate treatment.

The interconnection of these controls has not been illustrated in detail. Their use is well known and the person skilled in the art could connect them to perform the stated functions.

At the commencement of the treatment, the table sections are in or close to abutting relation. Air pressure, predetermined to the patient's needs, is admitted through inlet 54 to extend the piston rod 47 and carry the lower body section 18 outwardly. This applies traction to the patient's lumbar region. The predetermined tension is eventually achieved and held until the time set by the treatment timer expires, air pressure is cut off from inlet 54 and applied to inlet 56 to retract the piston rod 47 and lower body section 18 as noted above. When the table sections are in abutting relationship, they are held in that position for the duration of time as set by the pause timer. This cycle is repeated for the period set by the timer 62.

The cyclical nature of the treatment can be controlled automatically. After setting the amount of traction by dial 64, one sets the time of application of traction by dial 62 and the amount of pause by dial 63. The total amount of time of treatment may also be automatically set by a dial (not shown).

Traction is usually applied for between 0.5 minutes to 1 minute; rest periods usually vary for similar duration. The cycle is repeated 10 to 20 times and treatments are beneficially given from 1 to 3 times a day. Variations are of course possible. The foregoing are only by way of example.

The detailed connection of the controls to achieve the supply and direction of the pneumatic pressure as described is not shown in detail. It is capable of variation and well known to those skilled in the art.

Thus there is provided means for cyclically applying traction to the spine. The pressures and the times are a matter of medical skill and practice.

Means are preferably provided for restraining the rate of movement of the lower body section. It will be apparent that air is admitted suddenly to the pneumatic cylinder and that if the resulting rate of movement of the lower body section is unrestrained, it could cause discomfort. In the embodiment illustrated, this difficulty is overcome by a hydraulic force-absorbing or damping means device which slows the rate of movement until the pneumatic cylinder reaches the full extent of its travel.

The damping device includes a cylinder 72 with a piston 74 between its ends has a piston rod 76 secured to the lower-body section 18 as at 84. The cylinder is rigidly mounted on the frame as at 86.

The cylinder 72 is filled with a hydraulic fluid and has a fluid bypass 87 extending from one end to the other. Needle valve 88 controls the rate of flow through the bypass in one direction and needle valve 90 controls the rate of flow through the bypass in the other direction.

When the lower body section moves outwardly, the piston 74 moves to the right and displaces fluid from the right end of the cylinder through the bypass 87 and the valve 88 to the left end of the cylinder. The valve is adjusted to provide resistance to this displacement and thus control the rate of movement of the lower body section 18 under the influence of the pneumatic pressure in the cylinder 46 as it applies traction.

As noted, the application of traction is for a predetermined time only. After traction has been applied for the predetermined time the action of the pneumatic cylinder is reversed.

The lower body section 18 retracts and the piston 74 in the hydraulic cylinder 87 moves to the left direction as viewed in FIG. 3. As it does so, hydraulic fluid moves from the left section to the right section through the bypass conduit 87 and needle valve 90. Needle valve 90 is adjusted to achieve a proper rate of movement by initially resisting the movement of the pneumatic piston.

The needle valves are adjusted to achieve rate of movement as required to provide a comfortable slow rate of applying traction and retraction to the patients.

The pelvic belt 44 is secured around the patient's pelvic region. It has two sections 92 and 94 which are secured round the patient's body by straps 96 and 98 and buckles 100 and 104. Extending from the belt are pull straps 106 and 108. As illustrated in FIG. 1, straps 110 connects the straps 106 and 108 to the pelvic belt traction measuring meter 42. In use, when the table separates, the lower-body support section 18 slides rearwardly and causes tension to develop to provide traction to the patient's lumbar region. The single strap belt may be replaced with a multi-strap belt if desired.

The pelvic belt is designed so that the straps are connected to the pelvic belt in a manner which locates the posterior straps directly in line with the patient's spinal column. The anterior straps are attached to the belt so as to position the attachment over the anterior superior spine of the Iliac crest of the pelvis.

The lateral traction pelvic belt is designed with straps attached to each side of the belt.

It will be appreciated that the patient may be further secured at his upper body region to the upper body section by a thoraic vest attached to the upper body section but it has been found that the patient is more comfortable without this attachment. Generally, when the patient's upper body is anchored by voluntary hand gripping, he tends to be more relaxed because he is aware that if the traction applied is excessive he can let go. The patient, himself, can also terminate the cycle and treatment session by pressing the stop button 70 which is within the patient's reach on the control box 58.

When the therapeutic table is started, the lower body section abuts the upper body section. The pressure of operation for the pneumatic cycle is set as determined by a qualified medical person with the pressure regulator switch 60. The timer 62 which directs the application of pressure between the two inlets is also set. In the embodiment illustrated, treatment sessions are terminated by pressing the stop button 70 but, alternatively, a second timer, if provided, may be preset to terminate the treatment when the end of the treatment period should occur.

The needle valves 88, 90 on the hydraulic restraining cylinder may also be adjusted to provide a desirable rate of separation.

After the belt has been secured to the patient and the patient is prone face down as shown in FIG. 1, the treatment may be commenced.

When the operation has been commenced, air pressure is forced through inlet 54 into the pneumatic cylinder 46 to move its piston and piston rod 47. The movement of the piston rod 47 pushes the lower body section 18 away from the upper body section 12. When the lower body section 18 moves, so does the hydraulic piston rod 76 and piston 74. The rate of separation of the lower body section is retarded by the rate of hydraulic fluid permitted to flow past needle valve 88 of bypass conduit 87.

After a period as set by timer 62 has expired, air pressure is redirected by the pumping means to enter the pneumatic cycle through inlet 56 instead of 54. This pushes the pneumatic piston 74 and piston rod 76 in the opposite direction to pull the lower body section 18 toward the upper body section 10. As aforementioned, when the lower body section 18 moves, so does the hydraulic piston rod 76 and the piston 74. However, the rate of closure of the two table sections is retarded by the rate that the hydraulic fluid permitted to flow past needle valve 90 of bypass conduit 87.

The distance of separation for the table sections is usually between 0 to 6 inches to take up slack in the belts and connections.

The time period for traction and relaxation are to be set to suit the particular requirements of the patient. After closure has been achieved and held for the specified period of pause, the air pressure will be again automatically redirected to the inlet 54 to start the cycle over again. These cycles are repeated for the duration of the treatment session.

It should be appreciated that aside from the pressures being applied to separate the table, there will be a frictional force between the patient and the table that will affect the separation of the sections. Because most of the weight of the patient is in his upper body, a substantial amount of this friction will be exerted against the upper body section 10. There are two obvious effects of this. Firstly, the friction of the upper body will reduce the amount of strength required by the patient for gripping the hand grips 28 when the sections are separating. Secondly, there is a lesser proportion of the patient's body weight resting on the lower-body section 18 that must be moved by the pneumatic piston.

The amount of pressure used for treatment is a function of the traction required for the patient and is determined by a qualified medical practitioner to suit the particular condition of the patient. This may vary between 25 pounds per square inch and 60 pounds per square inch for a pneumatic piston having a diameter of about 2 inches. The tension reading should be in the area of between 35 to 60 Kilo grams again depending on the condition of the patient. The average will be about 45 Kilograms.

The precise strength of traction registered by the traction measuring meter 42 is translated to digital readout on the traction tension gauge 66.

The traction measuring meter 42 which measures the tension is a device that is readily available on the market and a person skilled in the art would have no difficulty in incorporating it with a translating means for the purpose disclosed herein.

It will be noted that, in the embodiment illustrated, the moving parts of the table are pneumatically driven and that the patient does not come into contact with any electrically driven parts. In result, the patient is not subject to the danger of electrical shock. The meters used are battery-powered from a low-voltage power source.

The invention provides a non-surgical therapeutic table that is efficient to use and that alleviates back pain by cyclically applying traction and relaxation predetermined in respect of amount and time to the lumbar region through the use of a separating table.

It will be recognized that the embodiment illustrated is only one embodiment within the broader scope of this invention as herein claimed.

We claim:

1. A therapeutic table for use when applying traction to a patient's lumbar region when the patient is supported on the table in a prone position comprising:

a frame;

a table top having an upper-body section rigid with respect to said frame and a lower-body section slidably mounted with respect to said frame, said sections providing separable surfaces on which a patient may lie in a face-down prone position;

upper-body restraint means for restraining the patient with respect to the upper-body section, said restraint means including a pair of spaced hand grips which are rigid with respect to the upper-body section and extending upwardly from the plane of the table top to be accessible to a patient when resting upon the table with the arms extended above the head along the plane of the axis of the patient's spine to provide a manually releasable anchor for the upper body;

a pelvic belt anchor rigidly mounted with respect to the lower-body section to provide an anchor to which a pelvic belt can be connected;

extensible pneumatic cylinder and piston means extending between the frame and the lower-body section and operable to move the lower-body section with respect to the upper-body section to increase or decrease the distance between said upper-body restraint means and said pelvic belt anchor to apply traction through the patient's arms to the lumbar region of the spine;

said upper-body restraint means being completely releasable by the patient as said lower-body section moves with respect to said upper-body section to thereby permit the patient to limit the amount of traction placed on the lumbar region, hydraulic damper means extending between the frame and the lower body section for damping the movement of the lower body section with respect to the frame to control the rate of movement of the lower-body section with respect to the upper-body section;

means for alternately applying a predetermined pneumatic pressure to said pneumatic cylinder and piston means in a first direction and a second direction opposite to said first direction to cyclically apply traction to a patient in use;

traction measuring means mounted on said pelvic belt anchor and connectable to a pelvic belt trap for measuring the tension in the strap and thereby determining the traction load applied to the patient;

means for translating the traction load detected by the traction measuring means into a digital readout;

timing means responsive to the traction measuring means for controlling the timing of the movement of the lower-body section in each said direction.

2. A therapeutic table for use when applying traction to a patient's lumbar region when the patient is supported on the table in a prone position comprising:

a frame;

an upper-body section and a lower-body section each having a proximal end and a distal end, said table sections being mounted on said frame with their proximal ends located adjacent to and disposed opposite one another, said lower-body section being slidably mounted on said frame for longitudinal movement with respect to the upper-body section between a first retracted position and a second extending position to adjust the effective length of the table;

said upper-body section having:

(i) a first portion having a length extending from said proximal end toward said distal end which has a sufficient length to underly and support the upper body and head of a patient when the patient is resting in a prone position on said table; and (ii) a second portion having a length extending from the first portion to the distal end thereof;

upper-body restraint means for restraining the patient with respect to the upper-body section, said restraint means including a pair of spaced hand grip means which are projecting upwardly from said second portion of said upper-body section, said hand grip means being spaced from said first portion to a sufficient extent to require a patient resting in said prone position on said first portion to reach above the head in order to manually engage the hand grip means;

said lower-body section having a sufficient length between its proximal and distal ends to underly and support the lower body portion of a patient resting in said prone position on said table;

anchor means on said lower-body section;

a pelvic harness adapted to fit around the pelvic area of a patient, said pelvic harness being connectable to said anchor means for movement therewith;

extensible cylinder and piston means communicating with said lower body section and operable to cause said lower-body section to reciprocate to and from between said first and second position to cyclically apply traction to the lumbar region of a patient when a patient, wearing the harness, is resting in a face down prone position on the table with the pelvic harness secured to said anchor means and when the patient manually engages the hand grips; said upper body restraint means being completely releasable by the patient as said second table top member lower body section moves with respect to said upper body section to thereby permit the patient to limit the amount of traction placed on the lumbar region.

3. A therapeutic table as claimed in claim 2, wherein said cylinder and piston means comprises a double acting pneumatic ram which is extensible and retractable to effect movement of said lower-body section, and means for controlling air pressure to said ram to control the traction load applied by said ram.

4. A therapeutic table as claimed in claim 3, wherein the cylinder and piston means further comprises damping means for resisting the rate at which said ram can be extended and retracted.

5. A therapeutic table as claimed in claim 3, wherein said hand grips means are mounted for longitudinal adjustment with respect to said second portion of said upper-body section of said table so as to accommodate patients having different arm lengths.

6. In a therapeutic table for use when applying traction to a patient's lumbar region when the patient is supported on the table in a face-down prone position of the type having upper-body and lower-body sections mounted on a frame, the lower-body section being slidably mounted on said frame for movement with respect to said upper-body section between a first retracted position and a second extending position to adjust the effective length of the table, the improvement of;

upper-body restraint means for restraining the patient with respect to the upper-body section, said restraint means including a pair of spaced hand grips which are rigid and which project upwardly from said upper-body section, said hand grips located on said upper-body section such that it is necessary for a patient resting in said prone position on said upper body section to reach above the head in order to manually engage the hand grips; said upper body restraint means being releasable by the patient as said upper-body section slides relative to said upper-body section whereby the patient may limit the amount of traction applied to the lumbar region;

a pelvic harness;

anchor means on said lower body section adapted for connection to said pelvic harness to be worn by a patient;

extensible cylinder and piston drive means communicating with said lower body section and operable to apply a predetermined pressure to cause a lower-body section to reciprocate to and from between said first and second position;

timing means communicating with said cylinder and piston means to control the operation of said cylinder and piston means to cyclically apply traction to the lumbar region of a patient when a patient wearing the harness is resting in a face down prone position on the table with said pelvic harness secured to said anchor means and when the patient manually engages the upper body restraint means.

7. A therapeutic table as claimed in claim 6, wherein the cylinder and piston means further comprises damping means for resisting the rate at which the cylinder and piston means can be reciprocated.

8. A method of applying traction to the lumbar region of a patient by use of a therapeutic table having a frame to which is secured an upper body support section and a separate lower body support section, the said upper body support section being fixedly secured to the frame and including an upper body restraint spaced remotely from the lower body support section and wherein the lower body support section is moveable with respect to the upper body support section and in which a harness strap is secured to an end of the lower body support section remote from the upper body support section, and wherein the upper body restraint may be released by the patient as the lower body support section moves relative to the upper body support section, comprising the steps of:

(a) supporting a patient in a face-down prone position with the arms raised above the head and releasably grasping the upper body restraint, providing an extensible cylinder and piston means for automatically sliding the lower-body support section to cyclically apply traction to the patient, providing the upper-body restraint in the form of a pair of spaced hand grip means projecting upwardly from the upper-body support section;

(b) attaching the harness to the lumbar region of a patient to provide for the application of a traction load through posterior straps which are aligned with the patient's spinal column and through anterior straps to the ILIAC crest of the patient's pelvis, and (c) cyclically applying and removing a traction load to the harness, (d) timing the duration of the load applying the cycle and the load removing cycle, (e) controlling the rate at which the traction load is applied and removed during the load applying and load removing cycles, (f) allowing the patient to be free to completely release the spaced hand grip means at any time to completely remove the effect of the traction load at any time during the load applying cycle.

9. A therapeutic table for use when applying traction to a patient's lumbar region when the patient is supported on the table in a prone position comprising:

a frame;

a table top having an upper-body section rigid with respect to said frame and a lower-body section slidably mounted with respect to said frame, said sections providing a separable surface on which a patient may lie in a face-down prone position;

upper-body restraint means for restraining the patient with respect to the upper-body section, said restraint means including a pair of spaced hand grips which are rigid with respect to the upper-body section and extending upwardly from the plane of the table top to be accessible to a patient when resting upon the table top with the arms extended above the head along the plane of the axis of the patient's spine to provide a releasable anchor for the upper body;

a pelvic body anchor rigidly mounted with respect to the lower-body section to provide an anchor to which a pelvic belt can be connected;

extensible pneumatic cylinder and piston means extending between the frame and the lower-body section and operable to move the lower-body section with respect to the upper-body section to increase or decrease the distance between said upper body restraint means and aid pelvic belt anchor to apply traction through the patient's arms to the lumbar region of the spine; and hydraulic damping means extending between the frame and the lower-body section for damping movement of the lower-body section with respect to the frame to control the rate of movement of the lower-body section with respect to the upper body section;

means for automatically alternately applying a predetermined pneumatic pressure to said pneumatic cylinder and piston means in a first direction and a second direction opposite to said first direction to cyclically apply traction to a patient in use;

traction measuring means mounted on said pelvic belt anchor and connectable to a pelvic belt strap for measuring the tension in the strap and thereby determining the traction load applied to the patient;

means for translating the traction load detected by the traction measuring means into a readable form;

timing means for controlling the timing of the movement of the lower-body section in each said direction whereby the duration of each traction period and each relaxation period may be independently timed, and said upper-body restraint means being completely releasable by the patient as said lower-body section moves with respect to said upper-body section to thereby permit the patient to limit the amount of traction placed on the lumbar region.

10. A therapeutic table for providing traction in a prone position to a patient's lumbar region comprising:

a frame;

a table top having an upper-body section rigid with respect to said frame and a lower-body section slidable with respect to said frame;

the said sections providing, in use, a separable surface for a patient to lie prone face down on the table top with the patient's upper body resting on the upper-body section and lower body resting on the lower-body section;

upper-body restraint means for restraining the patient with respect to the upper-body section, said restraint means including a pair of spaced hand grips with are rigid with respect to the upper-body section and extending upwardly from the plane of the upper-body section table top to be accessible by the patient resting on the table top as aforesaid with arms above the head and along a plane of the axis of the patient's spine to provide a manually releasable anchor for the patient's upper body;

a pelvic belt anchor rigid with respect to the lower-body section to provide, in use, an anchor to which the pelvic belt can be connected;

extensible cylinder and piston means for automatically sliding the lower-body section in the frame to cyclically increase and decrease the distance between said hand grips and said pelvic belt anchors to cyclically apply traction through the patient's arms to the lumbar region of the spline in use;

and, said upper-body restraint means being completely releasable by the patient as said lower-body section slides with respect to said upper-body section to thereby permit the patient to limit the amount of traction placed on the lumbar region.

* * * * *